US007202647B2

(12) United States Patent
Okubo et al.

(10) Patent No.: US 7,202,647 B2
(45) **Date of Patent: *Apr. 10, 2007**

(54) POWER SUPPLY CIRCUIT

(75) Inventors: Takuya Okubo, Kyoto (JP); Ko Takemura, Kyoto (JP)

(73) Assignee: ROHM Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/372,145

(22) Filed: Mar. 10, 2006

(65) Prior Publication Data

US 2006/0152202 A1 Jul. 13, 2006

Related U.S. Application Data

(63) Continuation of application No. 10/873,224, filed on Jun. 23, 2004, now Pat. No. 7,071,663.

(30) Foreign Application Priority Data

Jun. 25, 2003 (JP) ..... 2003-180572

(51) Int. Cl.
*G05F 1/571* (2006.01)

(52) U.S. Cl. ..... 323/276; 323/274

(58) Field of Classification Search ..... 323/265, 323/273–276, 280, 281; 361/18
See application file for complete search history.

(56) References Cited

U.S. PATENT DOCUMENTS 4,890,185 A * 12/1989 Karl et al. ..... 361/91.6
4,891,728 A * 1/1990 Preis et al. ..... 361/18
6,037,759 A * 3/2000 Chen et al. ..... 323/280
6,208,123 B1 3/2001 Sudo
6,333,623 B1 12/2001 Heisley et al.
7,071,663 B2 * 7/2006 Okubo et al. ..... 323/276

FOREIGN PATENT DOCUMENTS

JP 08-190437 7/1996
JP 2000-22456 A 1/2000

* cited by examiner

*Primary Examiner*—Gary L Laxton

(57) ABSTRACT

A power supply circuit relating to the present invention comprises a differential amplifier for feeding out a voltage as a control voltage in accordance with a difference between a feedback voltage commensurate with an output voltage and a reference voltage, an output current control element for feeding out an output current in accordance with the control voltage fed thereto from the differential amplifier, an output line by way of which the output current is supplied to a load, a feedback line by way of which a voltage on the output line is fed back as the feedback voltage to the differential amplifier, the feedback line connected to the output line, and a clamping circuit for maintaining the control voltage so as not drop below a predetermined value.

2 Claims, 5 Drawing Sheets

POWER SUPPLY CIRCUIT

This application is a Continuation Application, which claims the benefit of pending U.S. patent application Ser. No. 10/873,224, filed Jun. 23, 2004 now U.S. Pat. No. 7,071,663. This disclosure of the prior application is hereby incorporated herein in its entirety by reference.

BACKGROUND OF THE INVENTION

1. Field of the Invention

The present invention relates to a power supply circuit for supplying a predetermined voltage to a load. More particularly, the present invention relates to a power supply circuit having a function of suppressing fluctuations in output voltage thereof caused by load fluctuations.

2. Description of the Prior Art

FIG. 4 is a circuit diagram of an n-channel FET driver 200 included in a conventional power supply circuit. In this n-channel FET driver 200, a positive side of a reference voltage source 2 is connected to a non-inverting input terminal (+ terminal) of a differential amplifier 1 by way of a line L3, and a feedback line L2 is connected to an inverting input terminal (− terminal) of the differential amplifier 1. A negative side of the reference voltage source 2 is grounded. Moreover, a gate of an n-channel FET 3 (hereinafter FET 3), i.e., an output current control element, is connected to an output terminal of the differential amplifier 1 by way of a line L4.

A drain of the FET 3 is connected to a first power supply E1 by way of a line L6, and a source of the FET 3 is connected to an output line L1. The feedback line L2, while being connected to the inverting input terminal (− terminal) of the differential amplifier 1, is also connected to the output line L1. One side of a capacitor 4 and one side of a load 5 are connected to this output line L1 respectively. Another side of the capacitor 4 and another side of the load 5 are connected to ground respectively.

The differential amplifier 1 converts a difference between a reference voltage Vref fed to the non-inverting terminal (+ terminal) thereof from the reference voltage source 2 and a feedback voltage Vb fed to the inverting terminal (− terminal) thereof through the feedback line L2 into a current according to a voltage-current conversion efficiency defined by a mutual conductance (or gain) Gm of the differential amplifier 1. The current thus converted is fed to the gate of the FET 3 through the line L4. This differential amplifier 1 is also connected to a second power supply E2 through a power supply line L7 and to ground through a grounding line L8.

Described hereinafter is how the n-channel FET driver 200 configured as above operates.

The differential amplifier 1 converts the difference between the reference voltage Vref fed to the non-inverting terminal (+ terminal) thereof from the reference voltage source 2 through the line L3 and the feedback voltage Vb fed to the inverting terminal (− terminal) thereof through the feedback line L2 into a current at the conversion efficiency in accordance with the mutual conductance Gm of the differential amplifier 1. Thus converted output current is fed to the gate of the FET 3 through the line L4. Accordingly, the FET 3 passes a source current thereof in accordance with the gate current thereof through the output line L1. Then, a voltage resulted from the source current is supplied to the load 5 as an output voltage Vo that also appears on the feedback line L2 as the feedback voltage Vb.

For example, assume that the load 5 changes from a heavy load to no load. Then, as shown in FIG. 5A, an output current (load current) Io becomes zero during a period T1 in which no load is applied. When the load 5 becomes a heavy load again after the period T1, the level of the output current Io becomes that under the heavy-load condition. The output voltage (load voltage) Vo changes according to changes of the output current Io as shown in FIG. 5B. In addition, a gate voltage Vg of the FET 3 changes as shown in FIG. 5C. All of these are the results of the operations described below.

When the load 5 changes from a heavy load to no load and the output current Io becomes zero at a time point t1, the output voltage Vo starts rising at the time point t1 and onward due to a transient phenomenon. The gate voltage Vg that is fed to the gate of the FET 3 from the differential amplifier 1 drops sharply at the time point t1 and is held at an L-level between a time point t2 and a time point t3 during which the FET 3 remains turned off.

Next, at the time point t3, the load 5 changes from no load to a heavy load. Then the output current Io starts flowing through the load 5. Furthermore, the output voltage Vo starts descending at the time point t3 and onward and drops by a voltage V2' at a time point t13. Thereafter, the output voltage Vo starts rising so as to return to the predetermined voltage, because the FET 3 is turned on by the gate voltage Vg having reached a predetermined level.

However, in the conventional power supply circuit configured as above, when the load 5 changes from no load or a light load to a heavy load, the gate voltage of the FET 3 must respond and rise from a low voltage. As a result, the response time will become relatively long for the following fluctuation of the load when the load fluctuates at a high frequency, thereby causing the transient response to get worsened. In the conventional power supply circuit configured in this way, the resultant slow transient response does not cause any serious harm when the load fluctuating frequency is low. However, when the load fluctuating frequency is high, it becomes impossible to stabilize the output voltage Vo quickly, because the FET 3 is unable to respond to that high frequency.

A semiconductor device and a supply voltage generating circuit disclosed in Japanese Patent Application Laid-Open No. Ho8-190437 uses a p-channel FET as an output current control element. In this configuration, an input voltage required for the p-channel FET should be set higher, which worsens its output efficiency. This disclosure also has a shortcoming in which two resistor elements are used for suppressing the amplitude of an output signal fed from a comparator circuit, thereby causing unnecessary power consumption.

SUMMARY OF THE INVENTION

An object of the present invention is to solve the problems mentioned above and to provide a power supply circuit capable of suppressing fluctuations of the output voltage under fluctuating load conditions to a minimum by improving the transient response, and also to provide a power supply circuit capable of reducing unnecessary power consumption.

To achieve the above objects, a power supply circuit relating to the present invention comprises a differential amplifier for feeding out a voltage as a control voltage in accordance with a difference between a feedback voltage commensurate with an output voltage and a reference voltage, an output current control element for feeding out an output current in accordance with the control voltage fed thereto from the differential amplifier, an output line by way of which the output current is supplied to a load, a feedback line by way of which a voltage on the output line is fed back as the feedback voltage to the differential amplifier, the feedback line connected to the output line, and a clamping circuit for maintaining the control voltage so as not drop below a predetermined value.

According to the power supply circuit configured in this way, the power supply circuit is designed in such a way that the control voltage of the output current control element is raised by the clamping circuit so that the output current control element can respond faster when the load changes from no load or a light load to a heavy load. As a result, it is possible to reduce fluctuations of the output voltage caused by fluctuating load conditions to a minimum and improve properties in the transient response.

Furthermore, the clamping circuit, by performing a clamping operation only when the control voltage drops below the output voltage appearing on the output line, maintains the control voltage at a level not below the output voltage. This allows the output current control element to respond faster when the load changes from no load or a light load to a heavy load. As a result, it is possible to reduce fluctuations of the output voltage caused by fluctuating load conditions to a minimum and improve properties in the transient response.

Furthermore, the clamping circuit, by performing a clamping operation only when the control voltage drops below the output voltage appearing on the output line, maintains the control voltage at a level not larger than a threshold value of the output current control element. This allows the output current control element to respond faster when the load changes from no load or a light load to a heavy load. As a result, it is possible to reduce fluctuations of the output voltage caused by fluctuating load conditions to a minimum and improve properties in the transient response.

According to another aspect of the present invention, an n-channel FET (field-effect transistor) is used as the output current control element. For this reason, the FET can operate even if the input voltage is low. This makes it possible to supply the output voltage to the load efficiently and reduce power consumption.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
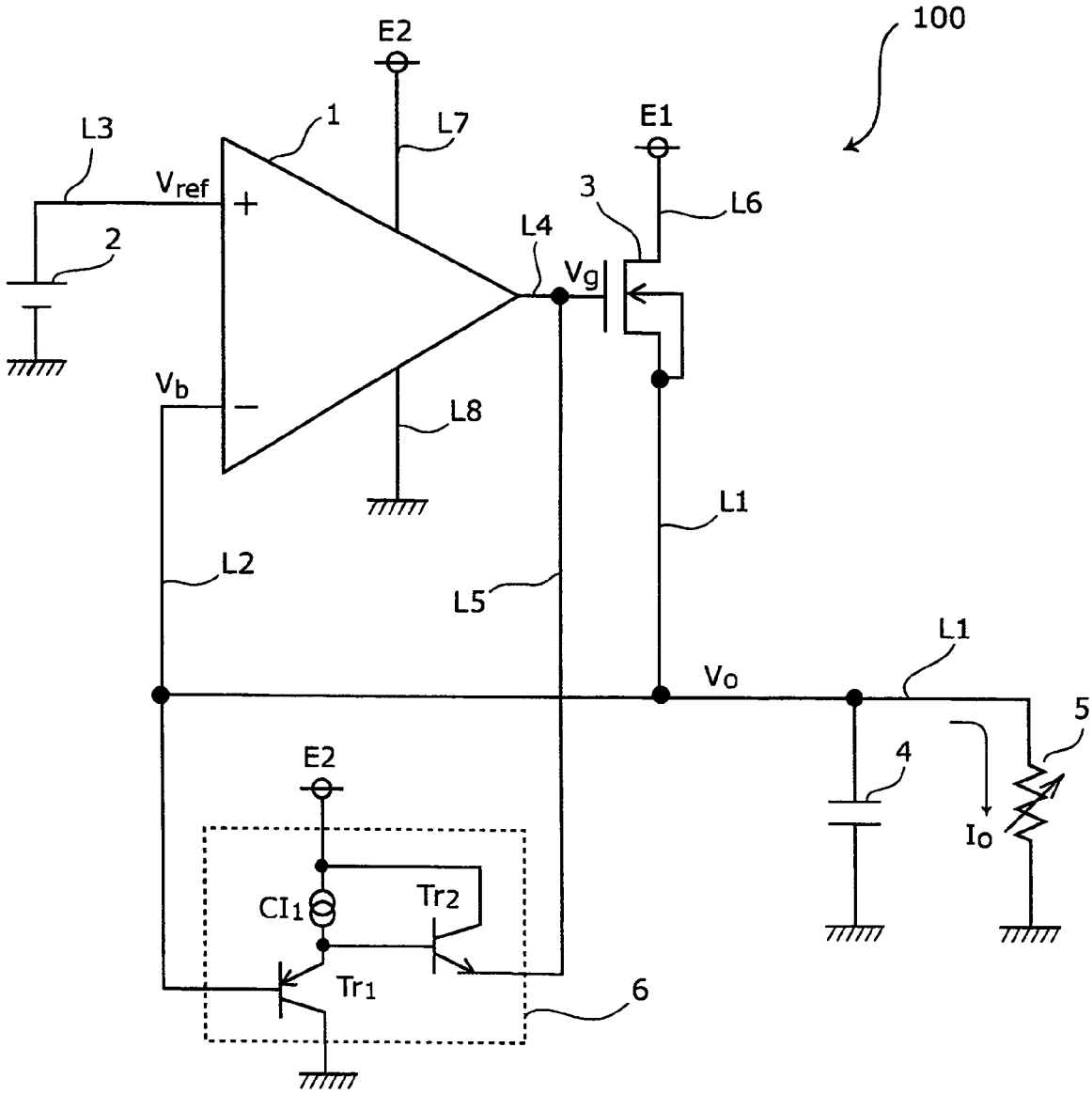
FIG. 1 is a circuit diagram of an n-channel FET driver included in a power supply circuit embodying the invention.

Hereinafter, an embodiment of the present invention will be described with reference to the drawings. FIG. 1 is a circuit diagram of an n-channel FET driver 100 included in a power supply circuit embodying the invention. In this n-channel FET driver 100, a positive side of a reference voltage source 2 is connected to a non-inverting input terminal (+ terminal) of a differential amplifier 1 by way of a line L3, and a feedback line L2 is connected to an inverting input terminal (– terminal) of the differential amplifier 1. A negative side of the reference voltage source 2 is grounded. Moreover, a gate of an n-channel FET 3 (hereinafter FET 3), i.e., an output current control element, is connected to an output terminal of the differential amplifier 1 by way of a line L4.

A drain of the FET 3 is connected to a first power supply E1 by way of a line L6, and a source of the FET 3 is connected to an output line L1. An input side of a clamping circuit 6 is connected to the feedback line L2 which is connected to the inverting input terminal (– terminal) of the differential amplifier 1. An output side of the clamping circuit 6 is connected to the line L4 through a line L5. Here, in FIG. 1, one example of the clamping circuit 6 is shown. The clamping circuit 6 shown as an example comprises a transistor Tr1 having an emitter thereof connected to a second power supply E2 through a constant current source CI1, a collector thereof connected to ground, and a base thereof connected to the feedback line L2; and a transistor Tr2 having a collector thereof connected to the second power supply E2, a base thereof connected to the emitter of the transistor Tr1, and an emitter thereof connected to the line L5. The feedback line L2 and the output line L1 are connected together. Connected to this output line L1 respectively are one side of a capacitor 4 and one side of a load 5. Another side of the capacitor 4 and another side of the load 5 are connected to ground respectively.

The differential amplifier 1 is connected to the second power supply E2 through a power supply line L7 and to ground through a grounding line L8. The differential amplifier 1 converts a difference between a reference voltage Vref fed to the non-inverting terminal (+ terminal) thereof from the reference voltage source 2 and a feedback voltage Vb fed to the inverting terminal (– terminal) thereof through the feedback line L2 into a current according to a voltage-current conversion efficiency defined by a mutual conductance (or gain) Gm of the differential amplifier 1. Thus converted current is fed to the gate of the FET 3 through the line L4.

Described hereinafter is how the n-channel FET driver 100 configured as above operates.

The differential amplifier 1 converts the difference between the reference voltage Vref fed to the non-inverting terminal (+ terminal) thereof from the reference voltage source 2 and the feedback voltage Vb fed to the inverting terminal (– terminal) thereof through the feedback line L2 into a current at the conversion efficiency according to a voltage-current conversion efficiency defined by a mutual conductance Gm of the differential amplifier 1. The output current thus converted is fed to the gate of the FET 3 through the line L4. Accordingly, the FET 3 passes a source current thereof in accordance with the gate current thereof through the output line L1. Then, a voltage resulted from the source current is supplied to the load 5 as an output voltage Vo that also appears on the feedback line L2 as the feedback voltage Vb.

Figure 2A:
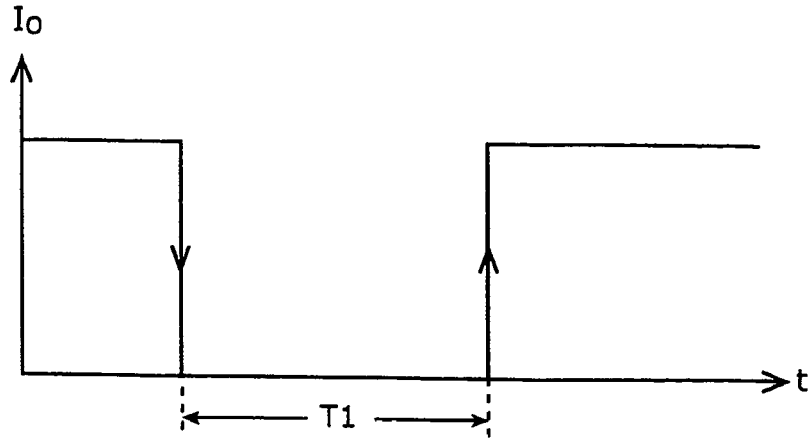
FIG. 2A is a waveform diagram showing an output current of the n-channel FET driver included in the power supply circuit embodying the invention.
Figure 2B:
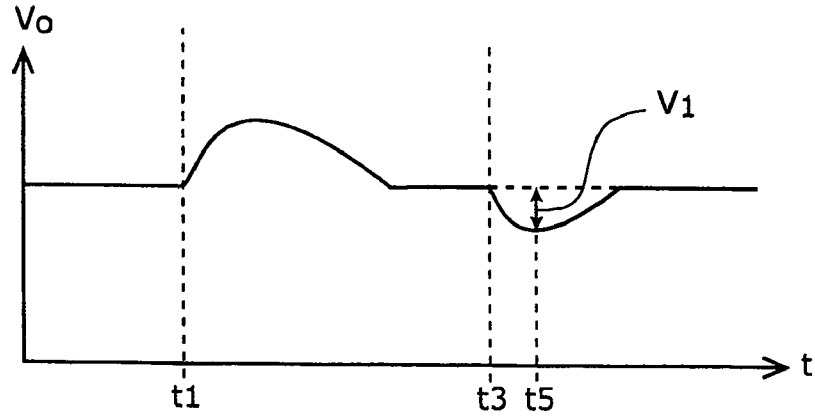
FIG. 2B is a waveform diagram showing an output voltage of the n-channel FET driver included in the power supply circuit embodying the invention.
Figure 2C:
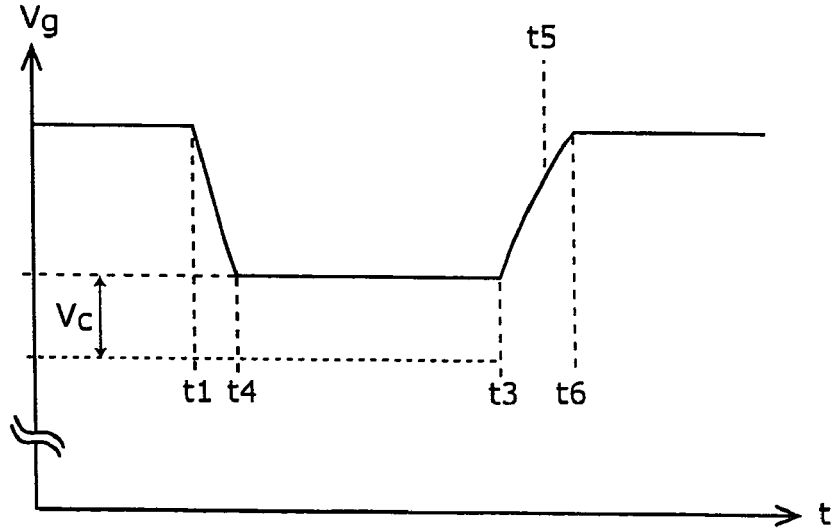
FIG. 2C is a waveform diagram showing a gate voltage of the n-channel FET driver included in the power supply circuit embodying the invention.

For example, assume that the load 5 changes from a heavy load to no load. Then, as shown in FIG. 2A, an output current (load current) Io becomes zero during a period T1 in which no load is applied. When the load 5 becomes a heavy load again after the period T1, the level of the output current Io becomes that under a heavy-load condition. The output voltage (load voltage) Vo changes as shown in FIG. 2B according to changes of the output current Io. In addition, a gate voltage Vg of the FET 3 changes as shown in FIG. 2C. All of these are the results of the operations described below.

The n-channel FET driver 100 shown in FIG. 1 operates so as to satisfy the following conditions.

$E2 \geqq Vo+Vth$ (Vth is a threshold voltage of the *EFT* 3)

$E1 \geqq Io \times Ron+Vo$ (Ron is an on-resistance of the *FET* 3)

The clamping circuit 6 performs a clamping operation in such a way that a voltage on the line L4, i.e., the gate voltage Vg fed to the gate of the FET 3, does not drop below the output voltage Vo. In addition, the clamping voltage is set at a value below the threshold voltage Vth of the FET 3. Taking all of these into account, the clamping circuit 6 performs operations described below.

After the load 5 changes from a heavy load to no load and the output current Io becomes zero, the output voltage Vo rises due to a transient phenomenon. When the gate voltage Vg of the FET 3 becomes lower than the output voltage Vo, the clamping circuit 6 performs a clamping operation by which the gate voltage Vg is raised to a predetermined level (clamping voltage) in a period between a time point t4 and a time point t3 as shown in FIG. 2C. To be more specific, the gate voltage Vg when the clamping circuit 6 is provided is raised by a voltage of Vc as compared with the gate voltage Vg when the clamping circuit 6 is not provided. This allows the output current control element to respond faster to the next fluctuation of load when the load changes from no load or a light load to a heavy load.

This means that, when the load 5 changes from no load to a heavy load at the time point t3, the output current Io starts flowing through the load 5. The output voltage Vo, due to a transient phenomenon, starts dropping at the time point t3 and finally drops by a voltage V1 at a time point t5. At this time point t5, the gate voltage Vg of the FET 3 reaches the threshold voltage of the FET 3. Thereafter, the output voltage Vo starts rising and returns to the predetermined voltage. However, the voltage V1 is smaller when compared to the conventional level, and a period between the time point t3 and the time point t5 is shorter when compared to the conventional period so that the transient response of the output voltage Vo is improved.

More specifically, during a period prior to the load 5 changing to the heavy load from no load, the gate voltage Vg is raised to a certain level by the clamping operation of the clamping circuit 6. When the load 5 changes to a heavy load suddenly under these conditions and the differential amplifier 1 starts responding to that change by raising the gate voltage Vg to an H-level, the voltage difference between the time point t3 and a time point t6 has been made smaller when compared to the conventional difference. This makes it possible for the FET 3 to respond faster to a load fluctuating at a high frequency, and, thereby, the transient response thereof is improved.

Figure 3A:
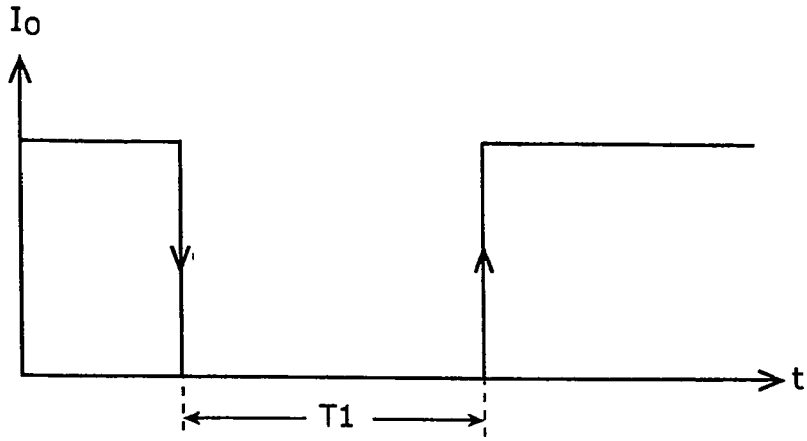
FIG. 3A is a waveform diagram showing the output currents of the n-channel FET driver with and without a clamping operation.
Figure 3B:
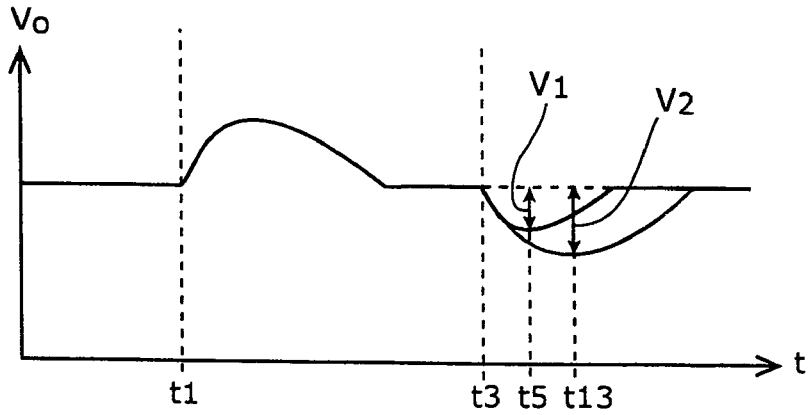
FIG. 3B is a waveform diagram showing the output voltages of the n-channel FET driver with and without a clamping operation.
Figure 3C:
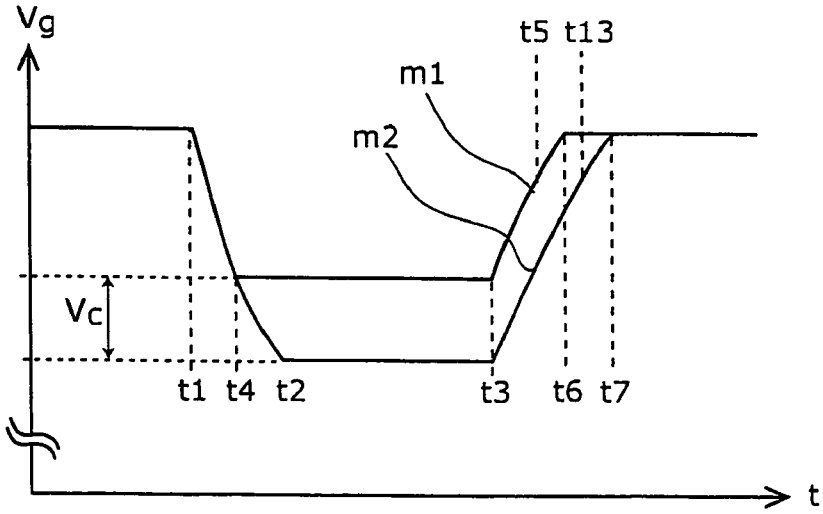
FIG. 3C is a waveform diagram showing the gate voltages of the n-channel FET driver with and without a clamping operation.
Figure 4:
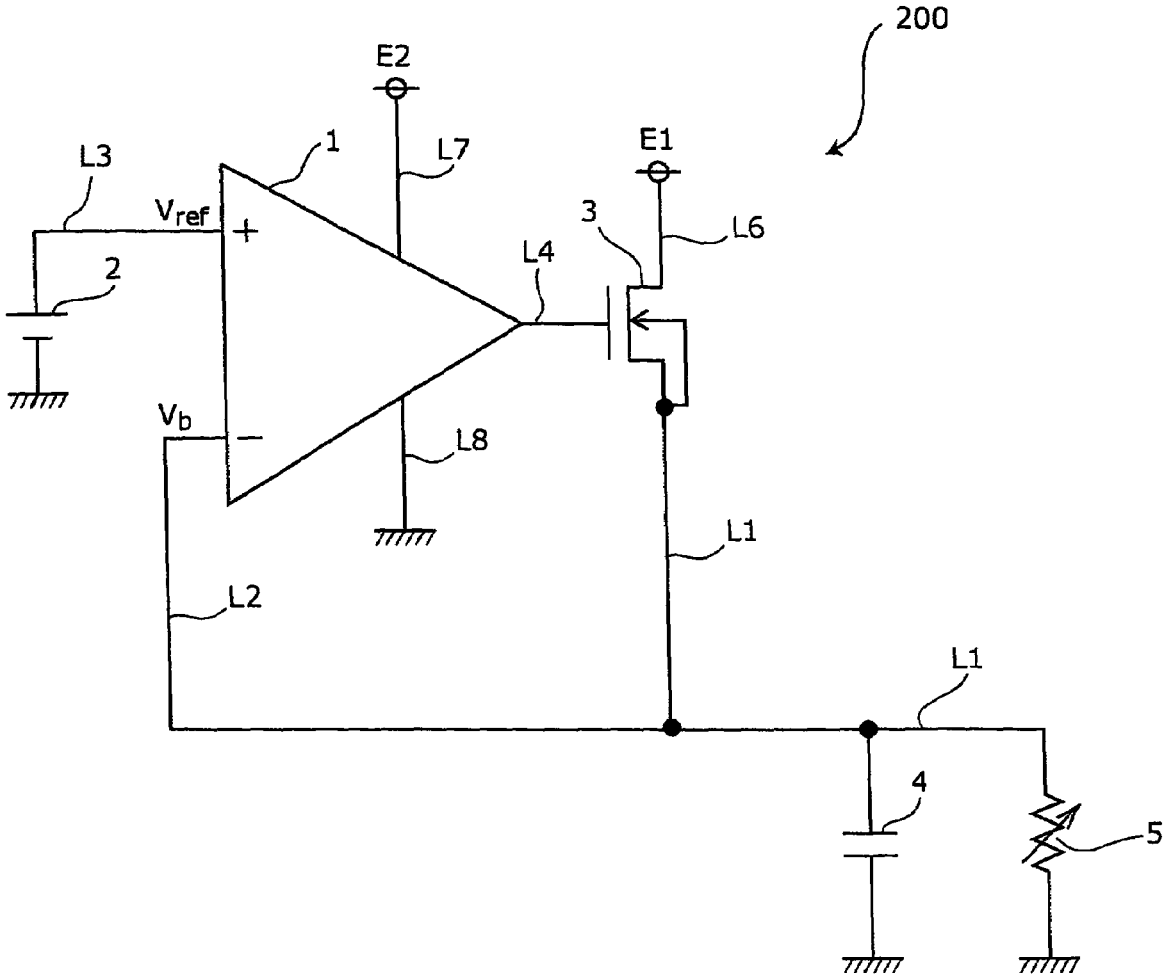
FIG. 4 PRIOR ART
FIG. 4 is a circuit diagram of an n-channel FET driver included in a conventional power supply circuit.
Figure 5A:
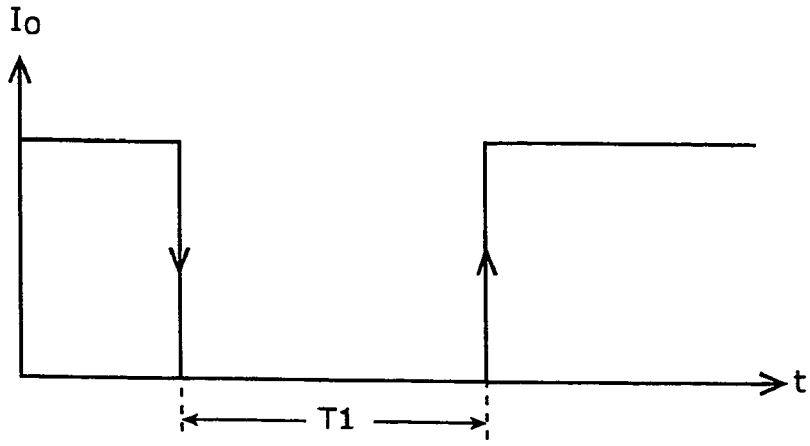
FIG. 5A PRIOR ART
FIG. 5A is a waveform diagram showing an output current of the n-channel FET driver included in the conventional power supply circuit.
Figure 5B:
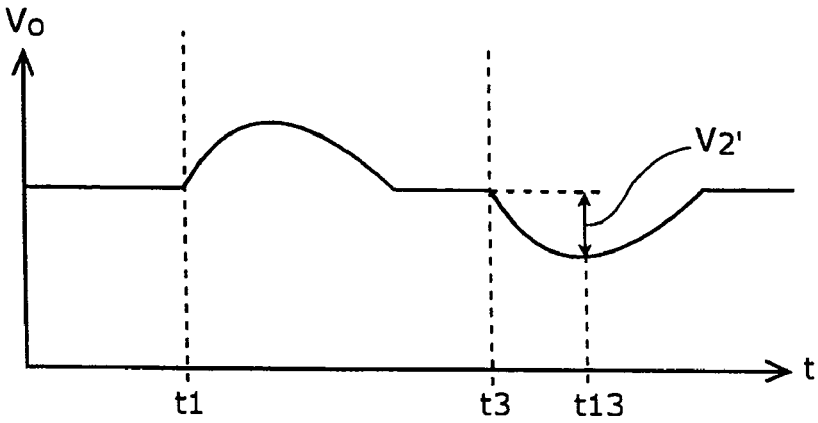
FIG. 5B PRIOR ART
FIG. 5B is a waveform diagram showing an output voltage of the n-channel FET driver included in the conventional power supply circuit.
Figure 5C:
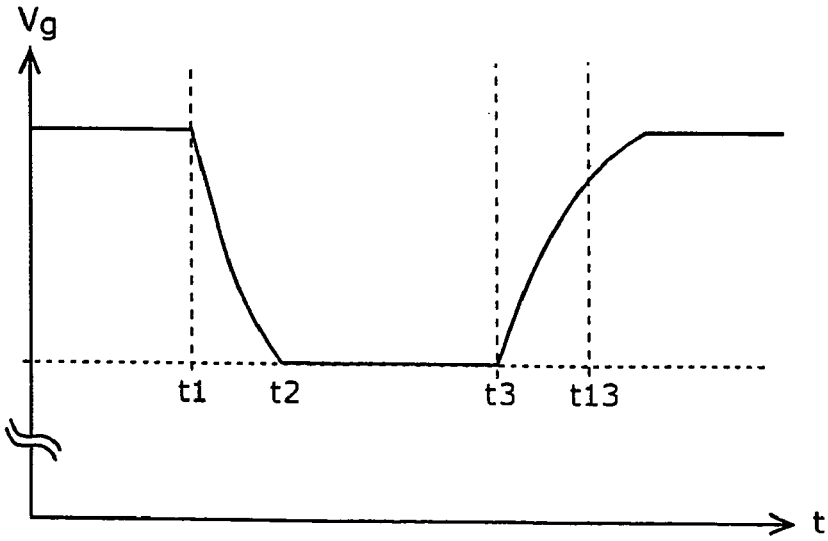
FIG. 5C PRIOR ART
FIG. 5C is a waveform diagram showing a gate voltage of the n-channel FET driver included in the conventional power supply circuit.

FIG. 3A is a waveform diagram showing the output currents for explaining a difference between operations of the n-channel FET driver 100 with and without a clamping operation performed by the clamping circuit. FIG. 3B is a waveform diagram showing the output voltages for explaining a difference between operations of the n-channel FET driver 100 with and without a clamping operation performed by the clamping circuit. FIG. 3C is a waveform diagram showing the gate voltages for explaining a difference between operations of the n-channel FET driver 100 with and without a clamping operation performed by the clamping circuit.

In FIGS. 3A to 3C, such components as are found also in FIGS. 2A to 2C and FIGS. 5A to 5C are identified with the same reference symbols or numerals. In FIG. 3B, an output voltage Vo found in a period after the time point t3 and having a fluctuation of the voltage V1 is shown as a voltage waveform when the clamping operation is provided. Another output voltage Vo found in the identical period after the time point t3 and having a fluctuation of the voltage V2 is shown as a voltage waveform when the clamping operation is not provided. It is understood from these waveforms that the voltage V1 is smaller than the voltage V2 and, therefore, the transient response is improved when the clamping operation is performed.

In FIG. 3C, a reference symbol m1 represents a line showing how the gate voltage Vg rises at the time point t3 when the clamping operation is provided, and a reference symbol m2 represents a line showing how the gate voltage Vg rises at the time point t3 when the clamping operation is not provided. More specifically, when the clamping operation is provided, the gate voltage Vg is kept raised after the time point t4, starts rising as shown by the line m1 at the time point t3, and reaches the threshold voltage at the time point t5. By contrast, when the clamping operation is not provided, the gate voltage Vg stays at an L-level between the time point t2 and the time point t3, starts rising as shown by the line m2 at the time point t3, and reaches the threshold voltage at the time point t13.

As found in FIG. 3C, the time required for the gate voltage Vg to reach the threshold voltage when the clamping operation is provided is shorter than the time when the clamping operation is not provided. With this arrangement, it is possible to make the FET 3 to respond faster and return the output voltage Vo to its predetermined voltage faster.

According to the embodiment described above, when the load 5 changes from no load to a heavy load, the gate voltage of the FET 3, i.e., an output current control element, is raised by the clamping operation performed by the clamping circuit 6 during the no-load period preceding the change in load condition. This makes it possible for the FET 3 to respond faster. Particularly, the FET 3 is capable of responding faster to a load fluctuating at a high frequency. As a result, it is possible to reduce fluctuations of the output voltage caused by fluctuating load conditions to a minimum and improve properties in the transient response. Furthermore, since an n-channel FET can be used as an output current control element as is the case for the FET 3, it is possible to reduce power consumption.

In the afore-mentioned embodiment, described are the cases where the load 5 changes from no load to a heavy load and, also, from a heavy load to no load. However, when the load 5 changes from a light load to a heavy load and, also, from a heavy load to a light load, the differential amplifier 1 and the FET 3 operate in a like manner because of their operational linearity, and produce the same effects. Also, it is to be noted that the circuit configuration of the clamping circuit 6 shown in FIG. 1 is an example. Therefore, it is needless to say that the present invention is not limited to this example and applicable also to such a circuit capable of performing the clamping operation in a manner explained previously.

What is claimed is:

1. A power supply circuit comprising:

a differential amplifier for feeding out a voltage as a control voltage in accordance with a difference between a feedback voltage commensurate with an output voltage and a reference voltage;

an output current control element for feeding out an output current in accordance with the control voltage fed thereto from the differential amplifier;

an output line by way of which the output current is supplied to a load;

a feedback line by way of which a voltage on the output line is fed back as the feedback voltage to the differential amplifier, the feedback line connected to the output line; and a clamping circuit to which the voltage on the output line is directly fed for maintaining the control voltage so as to not drop below a predetermined value when the load fluctuates during operation.

2. A power supply circuit as claimed in claim 1, wherein the output current control element is an n-channel FET (field-effect transistor).

* * * * *